US005848756A

United States Patent [19]

Sollinger et al.

[11] Patent Number: 5,848,756

[45] Date of Patent: Dec. 15, 1998

[54] METHOD AND DEVICE FOR THE CONTINUOUS WINDING UP OF A MOVING WEB

[75] Inventors: Hans-Peter Sollinger, Heidenheim; Rudolf Beisswanger, Steinheim; Ulrich Schettler, Schwabisch Gmund; Karl-Josef Boeck, Heidenheim; Zygmunt Madrzak, Heidenheim; Karl Rueck, Heidenheim, all of Germany

[73] Assignee: Voith Sulzer Papiermaschinen GmbH, Heidenheim, Germany

[21] Appl. No.: 793,675

[22] PCT Filed: Jun. 26, 1996

[86] PCT No.: PCT/EP96/02797

§ 371 Date: Jun. 9, 1997

§ 102(e) Date: Jun. 9, 1997

[87] PCT Pub. No.: WO97/01502

PCT Pub. Date: Jan. 16, 1997

[30] Foreign Application Priority Data

Jun. 28, 1995 [DE] Germany ..... 195 22 975.4
Jun. 28, 1995 [DE] Germany ..... 195 22 974.6

[51] Int. Cl.[6] ..... B65H 23/195; B65H 18/26

[52] U.S. Cl. ..... 242/412; 242/160.1; 242/541.4; 242/571.4; 242/609

[58] Field of Search ..... 242/160.1, 160.4, 242/410, 412, 413.3, 413.4, 413.5, 413.6, 413.7, 413.8, 541.4, 541.5, 541.6, 541.7, 545.1, 530.3, 547, 571.4, 609, 609.4, 610.4, 613

[56] References Cited

U.S. PATENT DOCUMENTS

| | | | |
|---|---|---|---|
| 2,350,369 | 6/1944 | Sampair et al. | 242/160.4 |
| 2,355,318 | 8/1944 | Moravek . | |
| 2,745,606 | 5/1956 | McCormack . | |

(List continued on next page.)

FOREIGN PATENT DOCUMENTS

| | | |
|---|---|---|
| 303507 | 11/1972 | Austria . |
| 0450311 | 10/1991 | European Pat. Off. . |
| 613849 | 9/1994 | European Pat. Off. . |
| 2741083 | 3/1983 | Germany . |
| 3347733 | 11/1985 | Germany . |
| 3627463 | 2/1988 | Germany . |
| 2932396 | 5/1988 | Germany . |
| 3816777 | 12/1988 | Germany . |
| 3729448 | 3/1989 | Germany . |
| 4007329 | 9/1991 | Germany . |
| 9305304 | 7/1993 | Germany . |
| 4321112 | 1/1994 | Germany . |
| 4401804 | 6/1994 | Germany . |
| 4402874 | 8/1995 | Germany . |
| 2168040 | 6/1986 | United Kingdom . |
| 91 17106 | 11/1991 | WIPO . |

OTHER PUBLICATIONS

Patent Abstracts of Japan, vol. 13, No. 45, (M–792), Feb. 2, 1989 & JP A 63 252853, Oct. 19, 1988.

(List continued on next page.)

*Primary Examiner*—John M. Jillions
*Attorney, Agent, or Firm*—Ostrolenk, Faber, Gerb & Soffen, LLP

[57] ABSTRACT

A method and device for the winding up of a moving web of paper (9) on a reel spool (11), as large a part as possible of the developing wound roll (12) having a high degree of winding hardness (WH), characterized by the fact that a relatively soft intermediate layer is formed between the wound roll (12) of high winding hardness and the winding core (11). This is achieved in the manner that, during a short initial phase of the winding process, it is ensured that the winding hardness (WH) is relatively slight in the innermost layers of the wound roll (12), whereupon an immediate transition to a relatively high winding hardness (WH) is effected which is being substantially maintained during the rest of the winding-up process. Alternately, the relatively soft intermediate layer can also be created in the manner that the reel spool (11A–11D) has a soft covering (41, 42, 43, 44, 45, 46, 47) on a metal reel spool body (40).

27 Claims, 4 Drawing Sheets

U.S. PATENT DOCUMENTS

| | | | |
|---|---|---|---|
| 3,031,152 | 4/1962 | Cohen et al. | 242/413.3 |
| 3,057,574 | 10/1962 | Justus | 242/413.3 |
| 3,179,245 | 4/1965 | Bastian | 242/160.1 |
| 3,179,349 | 4/1965 | Aaron et al. | 242/541.4 |
| 3,279,718 | 10/1966 | Arterton et al. | 242/547 |
| 3,298,626 | 1/1967 | Frick et al. . | |
| 3,346,209 | 10/1967 | Cronin | 242/541.7 |
| 3,390,762 | 7/1968 | Mernieks | 242/160.4 |
| 3,670,980 | 6/1972 | Mukai et al. | 242/547 |
| 3,878,999 | 4/1975 | Daves | 242/413.8 |
| 3,899,075 | 8/1975 | Hall et al. | 242/160.4 |
| 3,937,410 | 2/1976 | Justus | 242/541.5 |
| 3,977,619 | 8/1976 | Nagata et al. . | |
| 4,049,212 | 9/1977 | Yamaguchi et al. | 242/541.4 |
| 4,150,797 | 4/1979 | Kataoka | 242/541.6 |
| 4,496,112 | 1/1985 | Olsson et al. | 242/541.4 |
| 4,634,068 | 1/1987 | Malkki et al. . | |
| 4,697,755 | 10/1987 | Katoaka | 242/534 |
| 4,883,233 | 11/1989 | Saukkonen et al. . | |
| 5,154,367 | 10/1992 | Beisswanger . | |
| 5,184,787 | 2/1993 | Holzinger et al. . | |
| 5,265,812 | 11/1993 | Holopainen et al. . | |
| 5,335,871 | 8/1994 | Fissmann et al. | 242/595.1 |
| 5,370,327 | 12/1994 | Adamski | 242/541.6 |
| 5,407,143 | 4/1995 | Nakai et al. | 242/547 |
| 5,484,499 | 1/1996 | Marschke | 242/412 |
| 5,505,402 | 4/1996 | Vigneau | 242/547 |

OTHER PUBLICATIONS

Patent Abstracts of Japan, vol. 16, No. 314, (N–1278), Jul. 9, 1992 & JP A 04 089746, Mar. 23, 1992.

Patent Abstracts of Japan, vol. 13, No. 217 (M–828), May 22, 1989 & JP A 01 034839, Feb. 6, 1989.

J.D. Pfeiffer, "Internal Pressures in A Wound Roll of Paper", TAPPI, vol. 49, No. 8, Aug. 1966, pp. 342–347.

Paper, Film & Foil Converter, "The Art of Winding Good Rolls", by R. Duane Smith, Apr. 1991.

METHOD AND DEVICE FOR THE CONTINUOUS WINDING UP OF A MOVING WEB

BACKGROUND OF THE INVENTION

The present invention relates to a method for continuously winding up of a moving web in a winding machine for developing a soft intermediate layer between the winding core and the wound roll which has a high hardness. The invention furthermore relates to a device (winding machine) which is suitable for carrying out the method. Such a winding machine can either be a pure winding machine for webs of machine width or part of a roll cutting machine.

A winding machine is known, for instance, from German Patent DE PS 40 07 329 C2 or DE 44 01 959 A1. Another winding machine is described in European Patent Application EP 04 83 092 A1. Such a winding machine generally form the end section of a paper making machine or also of an off-line coating machines in order to bring the web of paper resulting there into the forms of a wound roll. During this process the paper web is wound onto a reel spool over its entire width. The reel spool is a roll-shaped winding core the diameter of which can be more than 0.6 m in the case of modern wide paper machines. For supporting the wound roll developing on the reel spool, the reel spool has bearing journals at its two ends by means of which journals it rests, for instance, on horizontal rails.

In other winding machines which, as a rule, are part of a roll cutter (see DE 38 32 601 and DE 32 21 929), longitudinally cut partial paper webs are wound onto sleeves. The length of each sleeve corresponds to the width of the corresponding partial paper web. The developing wound rolls are supported by at least one carrier roll; or a bed. For instance, a winding bed is formed of two carrier rolls or there are two winding beds formed of three carrier rolls. In addition, guide stands can be present and, a clamping head on each guide stand engaging into the corresponding sleeve.

The winding process is extremely important in paper making since at times there is the danger that paper which was up to that point produced without defects becomes so impaired upon winding that parts of a wound roll cannot be sold. The winding defects include so-called shiners, folds and tears. They are predominantly caused due to the fact that it is desired to create wound rolls of the greatest possible diameter and correspondingly high weight.

These winding defects are presumably produced as follows. When the paper web is being wound onto a reel spool and the wound roll has reached about 60 to 90% of its complete diameter, the high weight forces cause relative displacements of several layers of paper with respect to each other so that defective places result due to the sliding friction between the paper layers. Such defects occur mainly in the core region of the wound roll and therefore approximately in the region up to 25% of the layer thickness wound onto the reel spool. When a complete wound roll is later on unwound and these defective places become visible, the remaining paper web is cut off and becomes waste. For this reason, time and again there is an undesired loss due to waste.

Numerous theories exist as to how one can produce a wound roll which is free of defects. One theory, for instance, states that the winding hardness is to drop from a high initial value to a lower end value (see for instance DE 40 07 329 C2). It is the object of this method to wind the core region of the wound roll from the very start so tightly onto the reel spool that it is stiffened by the paper layers and this avoids the defective places which result for instance from sagging of the reel spool. This, however, may overstretch the web, possibly even tear it, and thus become useless. It has also been attempted to solve this problem by using reel spools of very high flexural stiffness (i.e. having a particularly large diameter), but frequently without success.

In accordance with JP-A-4-89746, a relatively slight winding hardness is produced at the start; then, it gradually increases to a maximum value at which the winding is finally completed.

In order to influence winding hardness, two parameters are available:

1. The web tension, i.e. the longitudinal tension with which a paper web travels onto the wound roll.
2. The line pressure, i.e. the force prevailing during the winding process in the nip which exists between a roll and the wound roll and through which the paper web travels.

The web tension is produced in different ways, depending on the design of the winding machine. In the case of a winding machine having a Pope-type reel, a drive for said Pope-type reel generally runs slightly faster than the drives of the web guide rolls in front of the Pope-type reel. In this way, the web tension is built up which, due to the static friction on the Pope-type reel, is then retained (at least to a substantial extent) up into the wound roll.

If the winding up of a web takes place without a Pope-type reel then, due to the introduction of a torque into the reel spool (central drive), the web tension is built up by a slightly higher circumferential winding speed as compared with the speed of the web.

There is also conceivable a combination of the above-mentioned methods or a build-up of tension solely between the drive of the Pope-type reel and the central drive of the reel spool.

Upon application of the above-described line pressure, the radius of the wound roll at the pressure point ("nip") is locally less than the radius outside the pressure point. Upon leaving the pressure point, the paper web thus experiences a longitudinal tension which increases the winding hardness. Of course, also in this case combinations with the above-described parameters are conceivable.

SUMMARY OF THE INVENTION

It is the object of the invention to develop a method for the continuous winding up of a moving web in which the portion of unsalable paper, cardboard, sheet or the like resulting from defects upon the winding, is smaller than in the case of the known methods.

This object is achieved by forming a relatively soft intermediate layer between the wound roll which is of high winding hardness and the winding core within.

It was found that the problem of the above-mentioned defects cannot be eliminated by a further increase in the winding hardness. In accordance with the invention, an entirely different method is employed for solving the problem: a relatively soft intermediate layer is formed—either in the region of the innermost layers of the developing wound roll or on the shell of the winding core (preferably a reel spool)—and it is furthermore ensured that the greatest possible part of the developing wound roll is formed with the greatest possible winding hardness directly on the soft intermediate layer or at the smallest possible radial distance therefrom.

This solution can be realized in different ways:

A) The formation of a soft intermediate layer "in the region of the innermost layers of the wound roll" means, in other words, that one deliberately creates a weak area in the core of the wound roll in which relative movements between adjacent paper layers can take place unimpeded. The following has surprisingly been found. If only the innermost layers of the wound roll, i.e. for instance the web layers (comprising at most about 5% of the total layer thickness) produced directly on the winding core (reel spool, winding sleeve or the like), are wound relatively softly, and if one thereupon immediately and as quickly as possible continues to wind with the previously customary high winding hardness, then "desired sliding places" result in the core which avoids further sliding places and thus further defective places developing in the constantly growing wound roll. There is thus available a substantially greater part of marketable web material than previously.

B) The same or at least a similarly good result is obtained if, by using a winding core (preferably a reel spool) provided with a soft covering, one sees to it that relative movements can occur between a generally hard wound roll and the hard metal body of the reel spool. In this case, therefore, the "soft intermediate layer" is part of the winding core, preferably the reel spool.

In accordance with U.S. Pat. No. 5,265,812 it has already been attempted to solve the above-described problem by providing the reel spool with a rubber or polyurethane covering (without indication of more precise details with regard to the properties of the covering) or by the reel spool having a double shell, wherein the outer shell is connected to the inner shell only at the so-called Bessel points. (This design causes unusually high manufacturing costs).

BRIEF DESCRIPTION OF THE DRAWINGS

The accompanying drawings indicate various embodiments of the invention.

DESCRIPTION OF THE PREFERRED EMBODIMENTS

Figure 1:
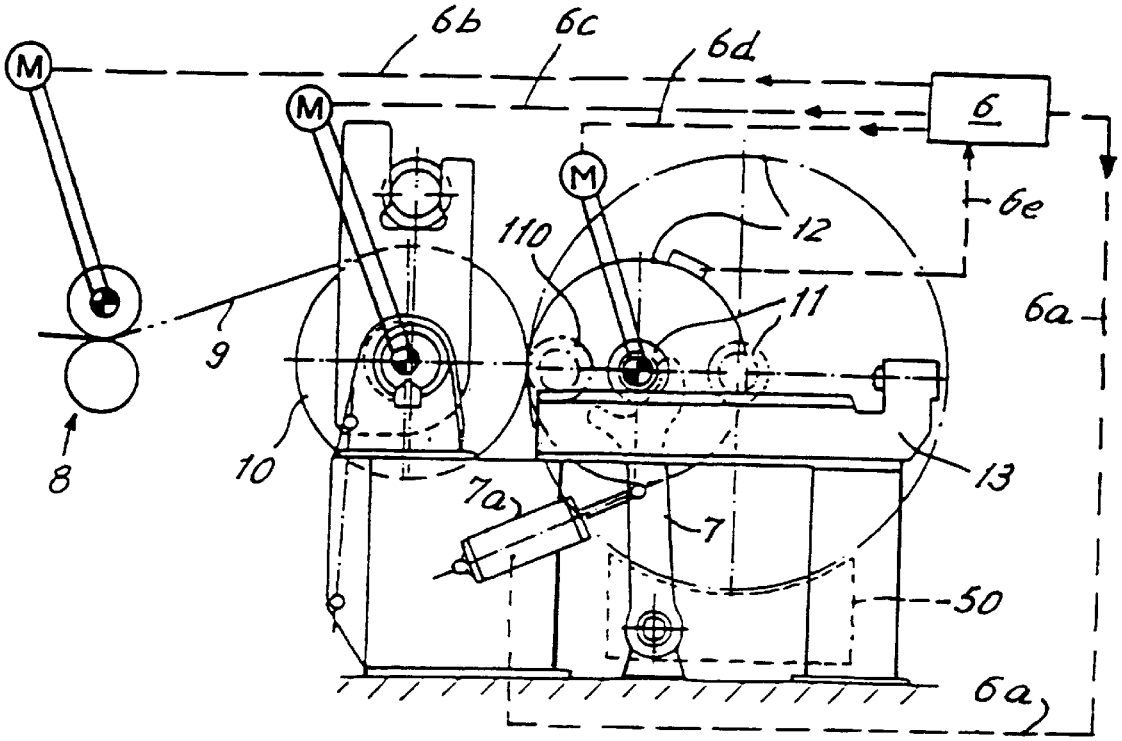
FIG. 1 shows in a diagrammatical lateral view a Pope-type reel winding machine (a so-called Pope roll).

In accordance with FIG. 1, the arriving paper web 9 first travels through a nip between web tension rollers 8, then partially wraps around a Pope-type reel 10 and is then wound onto a reel spool 11, producing a wound roll 12. Longitudinal rails 13 serve to support the reel spool 11 with the wound roll 12. By means of levers 7 and a lift device 7*a*, the reel spool with the wound roll can be pressed against the Pope-type reel 10. As a result, an adjustable line pressure is produced between Pope-type roll and wound reel. A control device 6 determines (via a control line 6*a*) the degree of the line pressure and furthermore via control lines 6*b*, 6*c* and 6*d*, the drives M for the tension rolls 8 and/or the Pope-type reel 10 and/or the reel spool 11. The control takes place, among other things, as a function of the increasing weight or the increasing diameter of the wound roll 12 respectively, for instance by means of a measuring line 6*e*.

The device described in FIG. 1 makes it possible so to vary the line pressure prevailing between the Pope-type reel 10 and the growing wound roll 12 that it will be relatively small during a relatively brief initial phase of the winding process and will then be increased rapidly. In addition or as an alternative, the so-called web tension can be varied, this being the web tension in the direction of travel of the web which is set in the paper web 9 by means of the drives. A given web tension can be set, for instance, by a slight difference in speed between the Pope-type reel 10 and the tension rollers 8 or another web guide device not shown (for instance, dry section or glazing rollers). If the reel spool 11, as shown, is provided with a so-called central drive, then a small difference in speed can also be set between the wound roll 12 and the Pope-type reel 10. There is the possibility in all cases to briefly set the web tension during the initial phase of each new winding process at a relatively small value, it being rapidly increased thereafter. During this initial phase (also already during the so-called reel spool change), the new reel spool 110 is preferably already on the rails 13. For this, the almost completed wound roll 12 is removed somewhat from the Pope-type reel 10. Then the levers 7 are immediately applied against the new reel spool 110 so as to be able from the start to commence with the control of the line pressure to be described.

Figure 3:
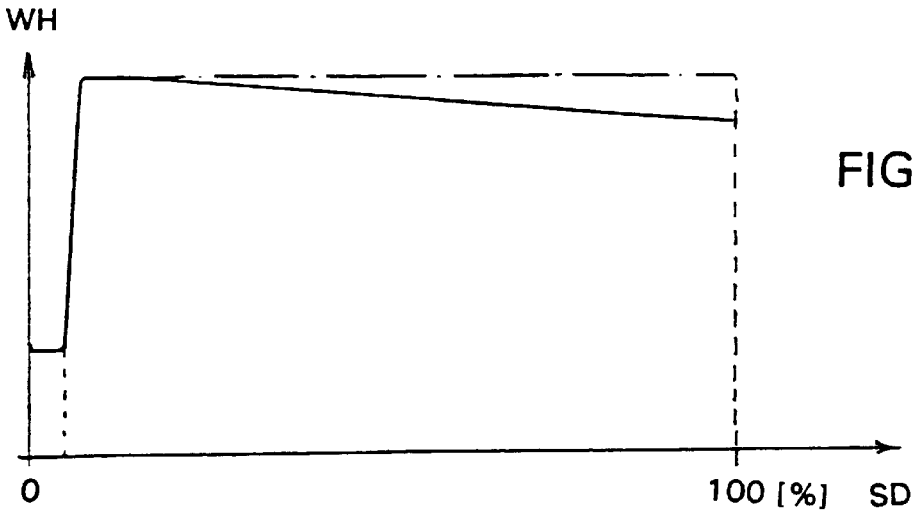
FIG. 3 is a diagram which indicates by way of example the desired profile of the winding hardness WH plotted over the web layer thickness SD wound onto a winding core.
Figure 4:
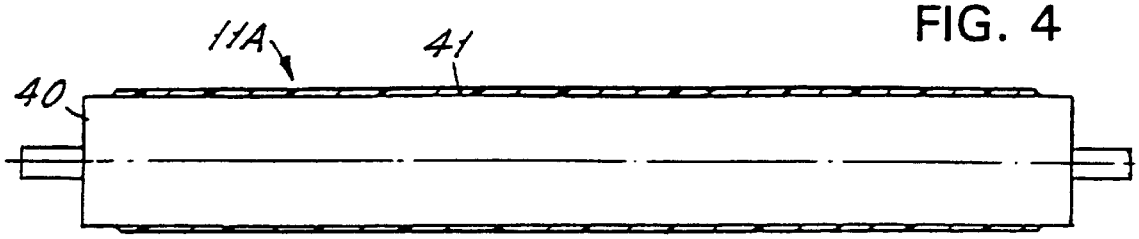
FIGS. 4 to 7 show different reel spool designs.

The above-described varying of the line pressure and/or of the web tension, assures that the winding hardness WH in each newly produced wound roll according to FIG. 3 will be relatively slight during a brief initial phase of the winding process but will thereafter be increased very rapidly to a relatively high value. The winding hardness WH can thereafter be reduced again very gradually with increasing web layer thickness SD or be maintained essentially constant or else be gradually increased further, depending on the requirements of the individual case or the type of paper.

Figure 2:
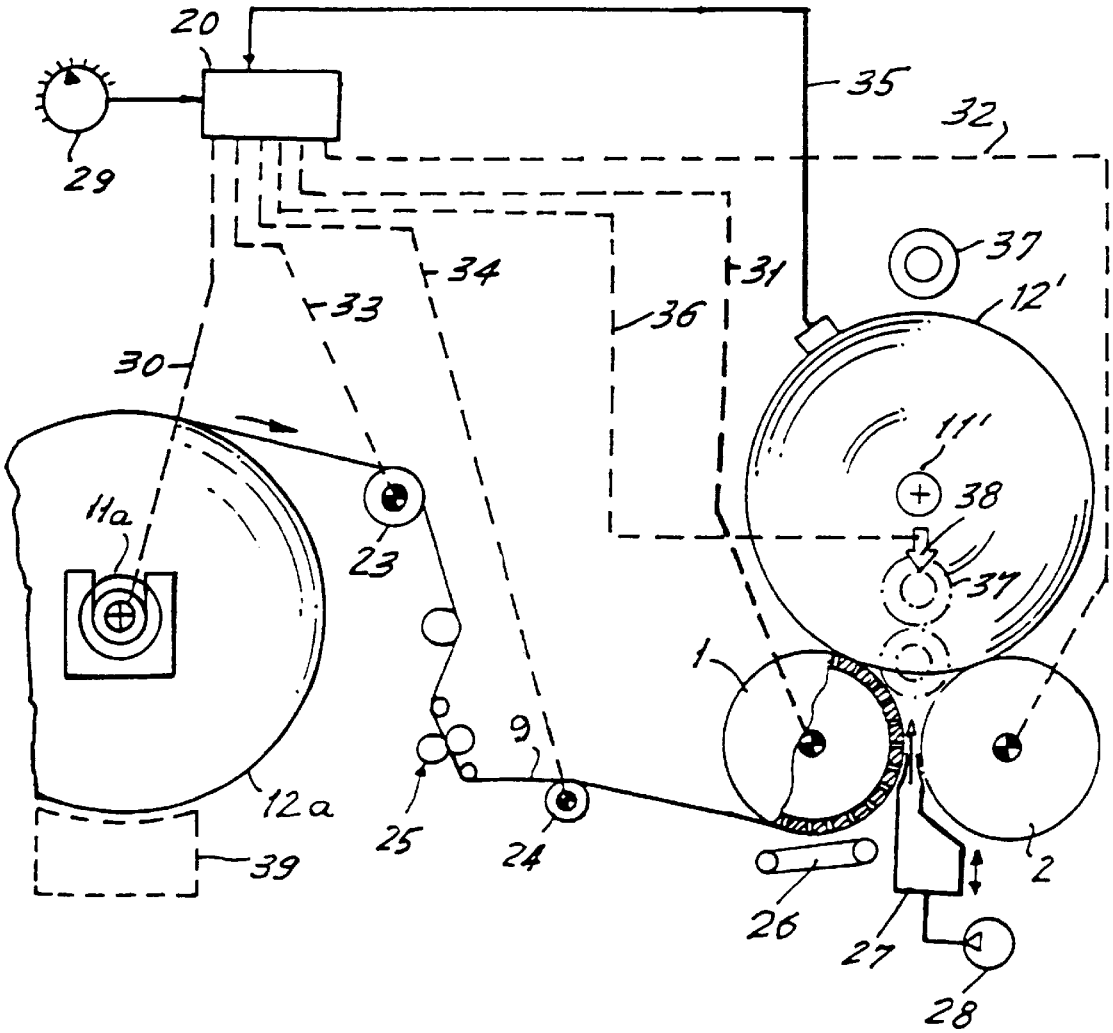
FIG. 2 shows diagrammatically a roll cutter.

A similar profile of winding hardness can be obtained upon the winding up of a paper web 9 in a roll cutter according to FIG. 2. In that case, the paper web 9 is unwound from an existing wound roll 12*a* having a reel spool 11*a*. The web travels over guide rolls 23, 24 and through a longitudinal cutting device 25 onto a first carrier roll 1 which, together with a second carrier roll 2, forms a winding bed for the developing new wound rolls 12'.

There are also indicated diagrammatically a web guide 26 as web draw-in aid and a compressed air box 27 having a blower 28 for forming a compressed air cushion between the carrier rolls 1, 2 and the wound roll 12'. That air cushion serves to reduce the bearing load of the wound roll on the carrier rolls when the diameter of the wound roll 12' exceeds a given value. There can furthermore be noted a load roller 37 by which the still small wound roll can be pressed (by means of a pressing device 38) against the carrier rolls 1, 2. A control device 20 receives signals from a desired value transmitter 29 with respect to the amount of the desired operating speed and via the line 35 a measurement value concerning the instantaneous diameter of the wound roll 12'. The control device 20 controls, via the lines 30 to 34, the operating speeds of the unwinding station (wound roll 12*a*), the guide rolls 23, 24 and the carrier rolls 1, 2 and also, via the line 36, the amount of the force exerted by the load roller 37 on the wound roll 12'. For obtaining the winding hardness profile according to FIG. 3 and at the beginning of each winding process, one either briefly reduces the brake moment at the unwinding station (wound roll 12*a*) and/or one briefly reduces the drive moment at the carrier rolls 1, 2 relative to the other drives so as to thereby influence the web tension. Alternatively, or in addition, one can briefly reduce the pressing pressure (at 38) at the beginning of the winding process. Also in addition or alternatively, one can temporarily introduce a brake moment or a relieving force into the sleeves 11'. This is done via clamping heads (not shown) which engage into the sleeves and which are part of a guide device. The wound roll 12*a* of the unwinding station is advisedly supported, as long as its diameter is very large, by means of a weight relief device 39.

Figure 5:
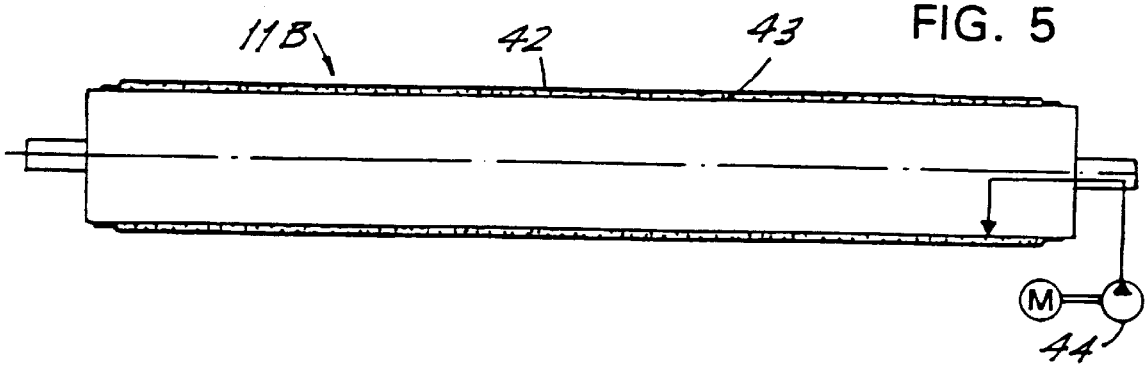
Figure 6:
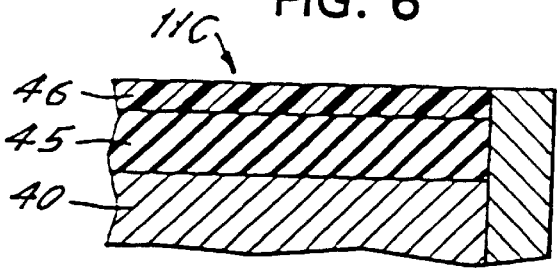
Figure 7:
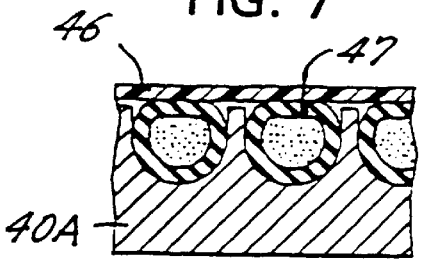

As an alternative to the measures described up to now, the result of which is shown in FIG. 3, or in addition to said measures, the reel spools 11 of the winding machine shown in FIG. 1 can be developed in accordance with one of FIGS. 4 to 7. The reel spool 11A is provided in FIG. 4 with a relatively thick and soft covering 41 which is firmly attached over its entire length to the metal body 40 of the reel spool. The covering is highly resilient and it has a rubber hardness of 50–200 P&J, and preferably 100–150 P&J. Another possibility is shown in FIG. 5. In that case, instead of a covering, there is provided a thin additional outer shell 42 which is attached only at its two ends to the shell of the reel spool 11B so that an annular intermediate space 43 is formed which can be acted on by a pressure medium. The pressure is variable, for instance by varying the drive M of a booster pump 44. It is advantageous in this case to increase the pressure as a function of the increasing weight of the wound roll 12 (FIG. 1). FIG. 6 shows a detail of a reel spool 11C. In that case, a soft rubber layer 45 is applied to a metal roll body 40 and a hard-rubber layer 46 is applied to the soft rubber layer. The hard rubber layer 46 can also be replaced by a thin metal jacket. In accordance with FIG. 7, the soft rubber layer can be replaced by a tube 47 which is spirally wound onto the roll body 40A and the inside of which is acted on by pressure.

Upon each winding process and if required, one can,—in addition to forming a relatively soft intermediate layer between the wound roll and the core—counteract the increasing weight of the wound roll at least during the second half of the winding process by means of a large-area relief device. For this purpose, various known devices can be used; see, for instance, DE 44 22 877.2 or EP 0 384 533 B1. Additional possibilities are indicated in FIGS. 8 to 10.

Figure 8:
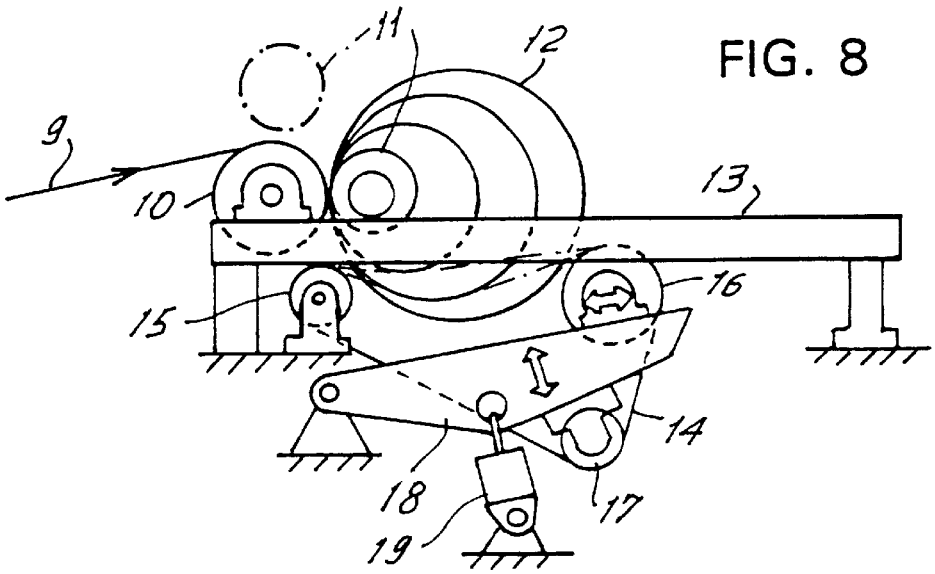
FIGS. 8 to 10 show possible variants of the winding machine shown in FIG. 1.

The essential parts of the winding device shown in FIG. 8 are the following: the arriving paper web 9, Pope-type reel 10, the reel spool 11, the wound roll 12, i.e., the paper web wound onto the reel spool, longitudinal rails 13 for supporting the reel spool with the wound roll, endless belt 14 for directly supporting the wound roll, and belt guide rolls 15, 16, 17. One roll 15 is mounted rigidly and driveable, and the others rest on swing levers 18, whereby the guide roll 16 can be displaced on the swing lever for tensioning the belt. A lift device 19 is for lifting the swing lever and thus for pressing the belt 14 from below against the wound roll 12.

When the would roll is full, it is moved away from the Pope-type reel, i.e., towards the right on the longitudinal rails 13. For this purpose, swing levers 18 and guide roll 16 are swung away. If desired, the belt 14 comes into contact with the wound roll 12 only when the latter has reached a certain size.

Figure 9:
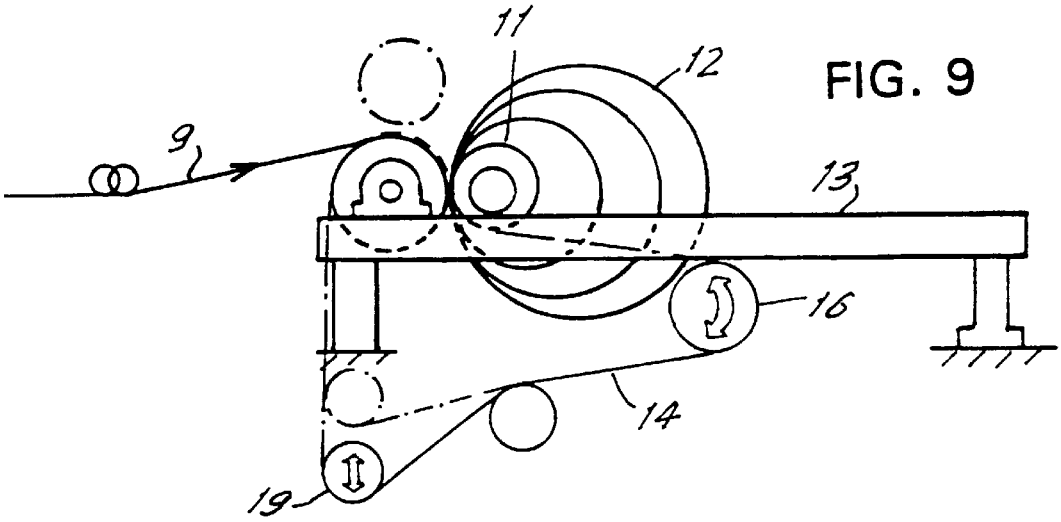
Figure 10:
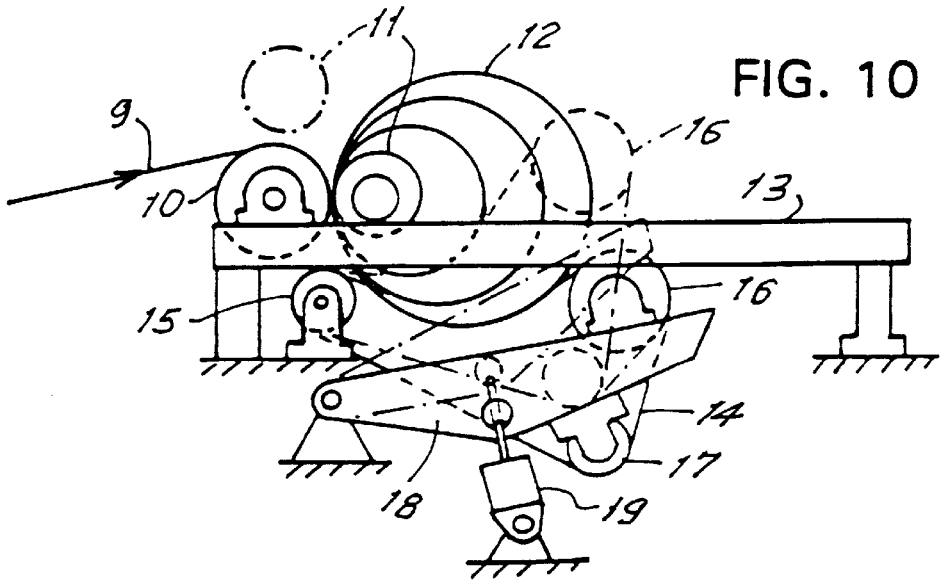

In FIG. 9 the Pope-type reel 10 assumes the function of the driveable belt guide roll 15 of FIG. 8. An additional tensioning roll 19 for the belt 14 can be displaced approximately vertically.

FIG. 10 is a variant of FIG. 8. The belt guide roll 16 can be swung far upward so that, if required, the belt 14 supports the wound roll 12 from the start and presses the wound roll against the Pope-type reel 10.

These embodiments have in common is the fact that a large area relief force is exerted on the wound roll by means of a single endless belt which extends over the width of the machine and travels over guide rolls. As a result of this measure, it can be expected that an even higher percentage of a wound roll will be available as marketable paper than solely as a result of providing a soft intermediate layer.

We claim:

1. A method for winding up a moving web of paper onto a winding core on a reel spool comprising:

rotating the winding core, and feeding the paper web to the core in a manner such that initially a soft intermediate layer of the paper web is formed on the winding core, and then winding the web with a high winding hardness, for forming a relatively soft intermediate layer between the winding core and the wound roll of high winding hardness, wherein the winding up method includes a brief initial phase of winding the web on the core during which a relatively slight winding hardness is provided to the web in the innermost layers of the wound roll on the core, immediately thereafter applying a relatively high winding hardness to the web after an immediate transition and then conducting the remainder of the winding process, and wherein following the immediate transition to a relatively high winding hardness, substantially maintaining a relatively high winding hardness during the remainder of the winding process.

2. The method of claim 1, wherein the web is wound on a winding machine including a support roll;

the method further comprising pressing the wound roll which is on the reel spool against the support roll for establishing line pressure between the roll being wound and the support roll;

controllably varying the line pressure for establishing the slighter winding hardness in the inner layers of the wound roll by applying an initially brief, relatively slight line pressure and thereafter in the immediate transition rapidly increasing the line pressure.

3. The method of claim 1, further comprising driving the reel spool for introducing a controllable torque to the wound roll for varying the web tension on the wound roll including setting the slight winding hardness in the inner layers of the wound roll by setting initially a brief slight torque on the wound roll and then in the immediate transition rapidly increasing the torque for increasing the web tension and forming the harder winding.

4. The method of claim 2, further comprising setting the slight winding hardness by setting an initial brief reduction in the web tension by controlling the drive moment of the support roll to briefly reduce web tension.

5. A method of claim 1, wherein the web is wound on a winding machine including a support roll;

the method comprising the setting of the slight winding hardness is by at least one of the steps selected from the group consisting of:

pressing the wound roll which is on the reel spool against the support roll for establishing line pressure between the roll being wound and the support roll, while controllably varying the line pressure for establishing the slight winding hardness in the inner layers of the wound roll by applying an initially brief, relatively slight line pressure and thereafter in the immediate transition rapidly increasing the line pressure; and driving the reel spool for introducing a controllable torque to the wound roll for varying the web tension on the wound roll, including setting the slight winding hardness in the inner layers of the wound roll by setting an initially brief slight torque on the wound roll and then in the immediate transition rapidly increasing the torque for increasing the web tension and forming the harder winding; and setting the slight winding hardness by setting an initial brief reduction in the web tension by controlling the drive moment of the support roll to briefly reduce web tension.

6. The method of claim 1, wherein the web is wound on a winding machine including a support roll;

the method wherein the slight winding hardness is followed by a higher winding hardness is obtained by at least two of the steps selected from the group consisting of pressing the wound roll which is on the reel spool against the support roll for establishing line pressure between the roll being wound and the support roll, while controllably varying the line pressure for establishing the slight winding hardness in the inner layers of the wound roll by applying an initially brief, relatively slight line pressure and thereafter in a transition for rapidly increasing the line pressure; and driving the reel spool for introducing a controllable torque to the wound roll for varying the web tension on the wound roll, including setting the slight winding hardness in the inner layers of the wound roll by setting an initially brief slight torque on the wound roll and then in the transition rapidly increasing the torque for increasing the web tension and forming the harder winding; and setting the slight winding hardness by setting an initial brief reduction in the web tension by controlling the drive moment of the support roll to briefly reduce web tension.

7. The method of claim 1, further comprising initially unwinding the web from another reel on which the web had been wound and then passing the web to the winding core for winding on the core; and wherein setting the slight winding hardness in the inner layers of the wound roll on the spool comprises performing at least one of the steps selected from the group consisting of briefly reducing the brake moment on the other unwinding reel; and briefly introducing a reduced level of torque directly into the reel for the roll being wound.

8. The method of claim 7, further comprising while winding the web onto the core, supporting the reel being wound with the assistance of at least one carrier roll for the reel, the method of setting a slight winding hardness in the inner layers is selected from the group of steps additionally consisting of briefly reducing the drive moment of the carrier roll at the reel; and applying pressure by a load roller upon the wound roll toward the carrier roll during the winding and initially briefly reducing the pressure of the load roller upon the wound roller for providing a slight winding hardness in the inner layers.

9. The method of claim 8, further comprising longitudinally cutting the unwinding web into partial webs after the web is unwound from the outer reel and before the web is wound on the reel.

10. The method of claim 9, further comprising winding the partial webs on sleeves; and inserting a clamping head into each end of each sleeve on which a partial web is wound for providing a brief relieving force in the wound rolls through the clamping heads.

11. The method of claim 1, wherein the reel spool has a shell thereover and an intermediate space is defined between the reel spool and the shell thereover; the method further comprising connecting a pressure medium to the intermediate space and varying the pressure of the pressure medium in the space for achieving the selected winding hardness.

12. The method of claim 11, wherein the pressure medium is adjusted in pressure to be increased as a function of the increasing weight of the roll being wound.

13. A device for winding a moving web of paper onto a reel spool for forming a relatively soft intermediate layer around the winding core of the spool having a relatively slight winding hardness and for forming a wound roll of relatively high winding hardness outside the soft intermediate layer, wherein there is an immediate transition toward relatively high winding hardness outside the intermediate layer, the device comprising a winding machine including a winding core on which a web roll is wound;

a control device for controlling the winding hardness of the web being wound into the roll on the core, the control device being operable for operating the winding machine to provide a brief duration initial phase of winding with a relatively slight winding hardness in the inner layer of the wound roll and to immediately thereafter provide for relatively high winding hardness of the web on the reel.

14. The device of claim 13 wherein the winding machine further comprises a winding core in the form of a reel spool on the which the web is wound;

means for setting a high winding hardness of the web being wound; and the reel spool on which the web is initially wound having a soft covering.

15. The device of claim 14, wherein the reel spool has a peripheral shell, and the soft covering is connected substantially to the entire shell of the reel spool.

16. The device of claim 15, wherein the soft covering is highly resilient and has a rubber hardness in the range of 50–200 P&J.

17. The device of claim 16, wherein the covering has a rubber hardness in the range of 100–150 P&J.

18. The device of claim 14, wherein the reel spool has a shell with opposite ends and the soft covering is connected to the shell of the spool only in the regions of the opposite ends thereof.

19. The device of claim 18, wherein the shell is so placed on the spool that an annular intermediate space is present between the shell and the spool; and a pressure medium supply is connected with the intermediate space for enabling the space to be pressurized.

20. The device of claim 19, wherein the means for supplying pressure medium to the intermediate space enables the pressure medium to be varied.

21. The device of claim 19, wherein the covering is comprised of a metallic material.

22. The device of claim 14, further comprising a hard shell wrapped around the soft covering of the reel spool.

23. The device of claim 22, wherein the soft covering of the reel spool comprises a spirally wound tube and means for acting on that tube with pressure medium for pressurizing the tube and the soft covering.

24. The device of claim 13, further comprising a support device for exerting a large area relieving force on the wound roll as the wound roll is being formed.

25. The device of claim 24, wherein the device for exerting a large area relieving force comprises a pressure belt acting on the wound roll to support the wound roll.

26. The device in claim 24, further comprising a control device for initiating the variation in the relieving force as a function of the increasing weight of the wound roll.

27. The device of claim 26, wherein the control device is operable to regulate the degree of the relieving force to avoid, at least to a substantial extent, relative sliding back and forth of adjacent web layers in the wound roll resulting from vertical shear stresses occurring as a result of the net weight of the wound roll predominantly in the region of the horizontal central plane of the reel spool and the direction of which stresses is reversed at each half revolution of the reel spool.

* * * * *